United States Patent [19]

Figueroa

[11] 4,423,863

[45] Jan. 3, 1984

[54] EXERCISING DEVICE

[76] Inventor: Romulo A. Figueroa, 2275 Taft Ave., Malate, Metro Manila, Philippines, 3008

[21] Appl. No.: 377,323

[22] Filed: May 12, 1982

[51] Int. Cl.[3] ..... A63B 21/22

[52] U.S. Cl. ..... 272/73

[58] Field of Search ..... 272/73; 128/25 R

[56] References Cited

U.S. PATENT DOCUMENTS

| | | | |
|---|---|---|---|
| 330,430 | 11/1885 | Seiler | 272/73 |
| 3,309,084 | 3/1967 | Simmons | 272/73 X |
| 3,572,699 | 3/1971 | Nies | 272/73 |

FOREIGN PATENT DOCUMENTS

| | | | |
|---|---|---|---|
| 730035 | 3/1966 | Canada | 272/73 |
| 2534149 | 2/1977 | Fed. Rep. of Germany | 272/73 |
| 1070769 | 2/1954 | France | 128/25 R |
| 1478537 | 3/1967 | France | 128/25 R |
| 378581 | 8/1932 | United Kingdom | 272/73 |

OTHER PUBLICATIONS

Model TR 750J by AMF Whitley, 29 Essex Street, Maywood, New Jersey 07607, Physical Fitness Products for 1980.

*Primary Examiner*—Robert A. Hafer
*Assistant Examiner*—Arnold W. Kramer

[57] ABSTRACT

A stationary bicycle characterized by a hand operated cranking mechanism for rotating the front wheel and a pedal operated cranking mechanism for rotating the rear wheel. Bearing against each wheel is a pressure roller whereby the drag on each wheel can be incrementally adjusted to suit the desire of the user, thereby assuring proper exercise of the leg and arm muscles.

4 Claims, 3 Drawing Figures

EXERCISING DEVICE

BACKGROUND OF THE INVENTION

This invention generally relates to the field of exercising devices and more specifically, to a stationary exercising bicycle.

Exercising devices of the aforesaid nature come in the form of cycle-type exercising devices which normally exercises only the leg muscles.

SUMMARY OF THE INVENTION

It is the main object of the present invention to provide an exercising device in the form of a stationary bicycle having elevated front and rear wheels, and which includes cranking mechanisms for rotating the said front and rear wheels, said mechanisms being independently operated by hand and by the feet, thus enabling proper exercising of both the arm and leg muscles.

A related object of the invention is to provide an exercising device which is greatly simplified in construction but which is capable of giving a well rounded exercise to improve the strength, endurance and coordination of the user.

It is also an object of the invention to provide an exercising device which includes means for incrementally and accurately regulating the drag forced on the wheels. This permits use of the exerciser, providing a wider range of choice.

Another object of the invention is to provide a stationary bicycle-type exercising device which is compact, easy to operate and efficient for the purpose intended.

DETAILED DESCRIPTION OF THE DRAWING

Figure 1:
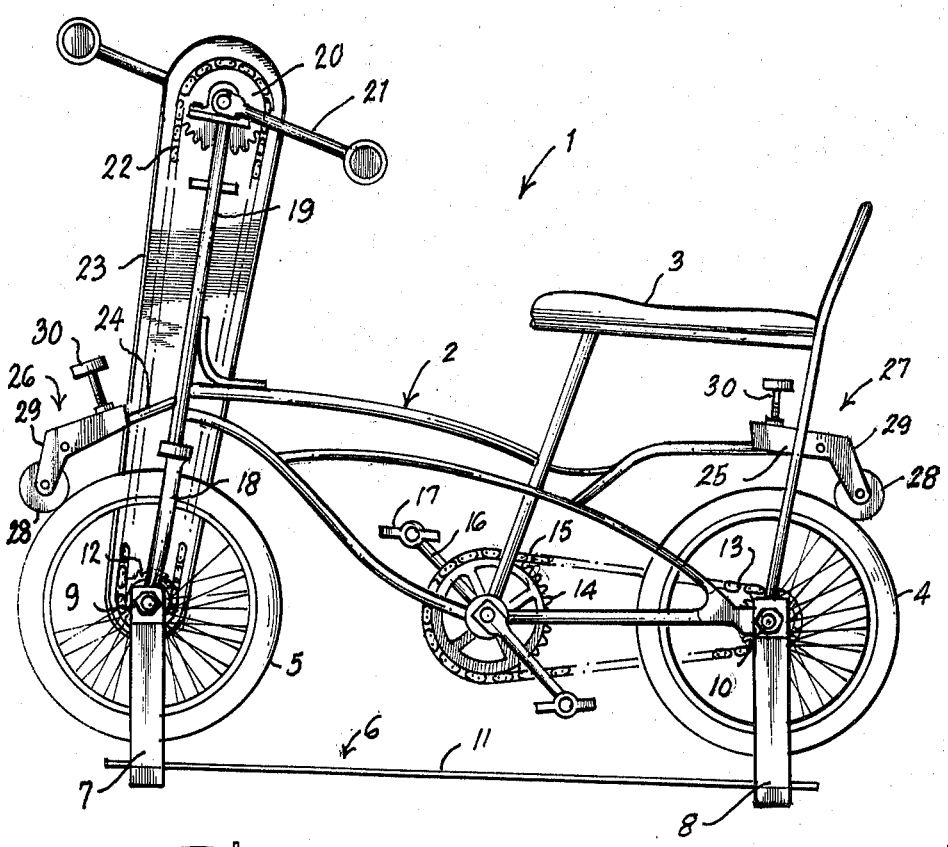
FIG. 1 is a side elevational view of the exercising device in accordance with the present invention.
Figure 2:
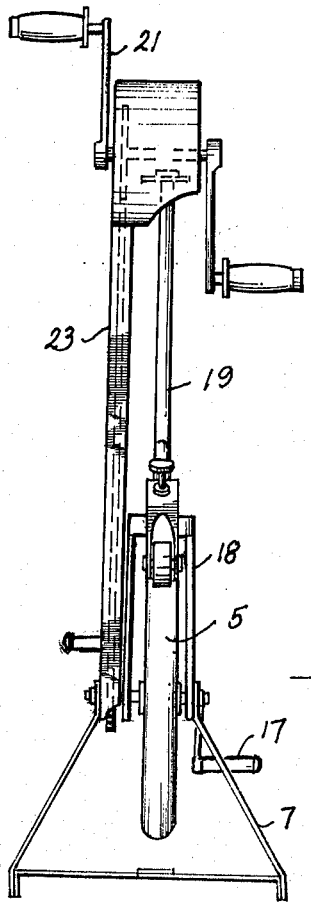
FIG. 2 is a front elevational view thereof.

Referring now to the drawing, the exercising device is shown as generally designated by the reference numeral 1.

The exercising device comprises a conventional bicycle frame 2, having a seat 3, a rear wheel 4 rotatively mounted at the rear end of the frame 2, and a front wheel 5 rotatively mounted at the front end of said frame 2.

The bicycle frame 2 is supported on a rigid base frame 6 which includes triangular legs 7 and 8 bolted to the front wheel axle 9 and rear wheel axle 10, respectively. The triangular legs 7 and 8 are connected by a brace 11. The base frame supports the bicycle frame in such a manner that the front and rear wheels are elevated, precluding frictional contact of the said wheels with the floor.

Fixed to the wheels axles 9 and 10 are the respective sprockets 12 and 13. The sprocket 13 is connected to the drive sprocket 14 by a chain 15. The drive sprocket 14 is rotated by the crank 16 thru the pedals 17.

Fixed to the front fork 18 is an upright post 19 and mounted at the top thereof is the drive sprocket 20. The drive sprocket 20 is rotated by hand thru the crank 21 and is connected by the chain 22 to the front wheel sprocket 12. The drive sprocket 20, chain 22 and sprocket 21 are enclosed by a chain guard 23.

Figure 3:
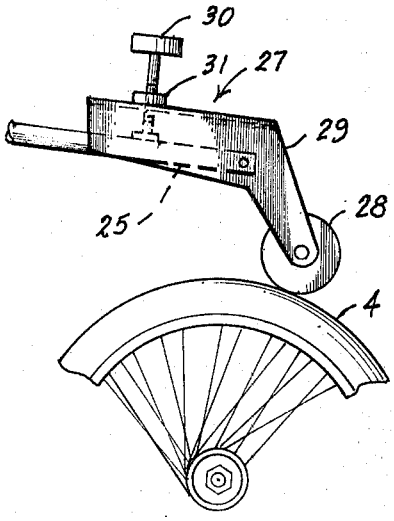
FIG. 3 is an isolated side elevational view of the pressure roller.

Provided at the front and rear of the bicycle frame 2 are the rigid extensions 24 and 25, respectively. Connected to the extension 24 is a pressure roller assembly 26 and likewise, a pressure roller assembly 27 is connected to the extension 25. Each pressure roller assembly consists of a roller 28, a housing 29 and a screw 30 which is threadably engaged with a nut 31 fixed atop the housing 29. As more clearly shown in FIG. 3, as the screw is rotated in a clockwise direction, the housing tip is moved downwardly, causing the roller to exert more pressure on the wheel, increasing the frictional drag thereat. Thus, in accordance with the desire and capability of the user. The drag wheel can be accurately and incrementally adjusted.

Since the front and rear wheels are rotated independently by hand and feet, proper exercise of the arm and leg muscles are assured.

Although the invention has been illustrated and described with reference to the preferred embodiment thereof, I wish to have it understood that it is no way limited to the details of said embodiment but is capable of numerous modifications which may lie within the scope of the appended claim.

I claim as new:

1. An exercising device comprising:

a conventional bicycle frame, a front and rear wheel rotatively mounted at the front and rear ends of said frame, respectively, a base frame supporting said bicycle frame in such a manner that said wheels are elevated, pedal operated means for rotating said rear wheel, hand operated means for rotating said front wheel, and incrementally adjustable means for decreasing or increasing the frictional drag on each of said wheels to suit the needs of the exerciser.

2. An exercising device as claimed in claim 1 wherein said means for rotating said rear wheel consists of a sprocket fixed to the rear wheel axle, a drive sprocket, a crank for rotating said drive sprocket, pedals for operating said crank, and a chain connecting said wheel sprocket and drive sprocket.

3. An exercising device as claimed in claim 1 wherein said hand operated means for rotating the front wheel comprises an upright post fixed to the front wheel fork, a drive sprocket mounted on top of said post, a hand crank for rotating said drive sprocket, and a chain connecting said drive sprocket to the front wheel sprocket.

4. An exercising device as in claim 1 wherein said incrementally adjustable means for increasing or decreasing the frictional drag on said wheels comprises a rigid extension and a pressure roller assembly consisting of a housing, a roller, and a screw bearing on said extension, said screw when rotated moves said housing causing the roller to engage the wheel to increase or decrease the frictional drag on the wheel.

* * * * *